US005727320A

United States Patent [19]

Shepherd et al.

[11] Patent Number: 5,727,320

[45] **Date of Patent: *Mar. 17, 1998**

[54] UTILITY KNIFE WITH BLADE MAGAZINE

[75] Inventors: Charles G. Shepherd, Oakville; Edward A. Funger, Burlington, both of Canada

[73] Assignee: The Nack Company Limited, Burlington, Canada

[ * ] Notice: The term of this patent shall not extend beyond the expiration date of Pat. No. 5,604,984.

[21] Appl. No.: 694,126

[22] Filed: Aug. 8, 1996

Related U.S. Application Data

[63] Continuation-in-part of Ser. No. 548,941, Oct. 26, 1995, Pat. No. 5,604,984.

[51] Int. Cl.[6] ..... B65B 1/10

[52] U.S. Cl. ..... 30/125; 30/40.2; 30/346.61

[58] Field of Search ..... 30/162, 163, 346.61, 30/331, 339, 125, 40, 40.2; 206/355, 356

[56] References Cited

U.S. PATENT DOCUMENTS

| | | | |
|---|---|---|---|
| 1,436,751 | 11/1922 | Browning | 30/346.61 X |
| 2,784,489 | 3/1957 | Reise | 30/351 X |
| 4,372,362 | 2/1983 | Ahn . | |
| 4,552,043 | 11/1985 | Corona et al. . | |

FOREIGN PATENT DOCUMENTS

| | | |
|---|---|---|
| 0207578 | 1/1987 | European Pat. Off. . |
| 8615168 | 8/1986 | Germany . |
| 8103593 | 2/1983 | Netherlands . |
| 2050227 | 1/1981 | United Kingdom . |
| 2161737 | 1/1986 | United Kingdom . |

*Primary Examiner*—Douglas D. Watts
*Attorney, Agent, or Firm*—Rogers & Scott

[57] ABSTRACT

A utility knife has a blade magazine removably mounted in a manually holdable housing and rotatable about an axis parallel to a longitudinal axis of the housing. The blade magazine has a series of radially and longitudinally extending circumferentially spaced blade-receiving slots for separately receiving thin blades having a cutting edge at at least one end thereof, each slot having an open front end to enable a blade therein to be removed from the magazine by forward movement through the front end of the slot. The housing also carries a slidable transport mechanism having a manually engageable actuator projecting from the housing and slidable in a longitudinal direction between front and rear positions, the transport mechanism also having a blade-engaging arm within the housing. Positioning of the actuator at the forward position causes a blade carried by the arm to project from the front end of the housing in an operative position, and movement of the actuator from the forward position to the rear position causes the blade to be retracted from the operative position into the housing and into an empty slot in the magazine. The magazine is rotatable to move the retracted blade from the arm of the transport mechanism and to position a new blade from another slot onto the arm for subsequent movement by the actuator to an operative position.

17 Claims, 7 Drawing Sheets

UTILITY KNIFE WITH BLADE MAGAZINE

This application is a continuation-in-part of application Ser. No. 08/548,941 filed Oct. 26, 1995 now U.S. Pat. No. 5,604,984, the contents of which are hereby incorporated herein by reference.

FIELD OF THE INVENTION

This invention related to knives, commonly known as utility knives, which have a manually holdable housing carrying a thin cutting blade which, in its operative position, projects forwardly from the housing. Most blades for such knives are double-ended, that is to say have opposite ends which are both operable as cutters so that, when one end is blunted, the blade can be reversed so that the other end forms the operative end. Such blades usually have a trapezoidal shape with a lower cutting edge which meets the inclined end edges of the blade to form acute cutting points at each end.

BACKGROUND OF THE INVENTION

Utility knives are used for a variety of purposes where a hand-held tool with a sharp cutting blade is required. When a blade has been used to an extent where one or both ends is blunted, it is necessary to replace the worn blade with a new blade. With most utility knives, the old blade is manually removed from the housing and a new blade fitted. This is not only time consuming, but also involves the danger of the operator being cut by the old or the new blade. Attempts have been made to provide utility knives with a supply of new blades in the housing and a manually operable mechanism which can be operated to move a new blade into the operative position. However, for various reasons, such knives have not proved to be particularly satisfactory in practice.

According to the invention described and claimed in parent application Ser. No. 08/548,941, a knife comprises a manually holdable housing having a front end and a rear end, and a blade magazine removably mounted in the housing and rotatable about an axis parallel to a longitudinal axis of the housing extending from the front end to the rear end. The blade magazine has a series of radially and longitudinally extending circumferentially spaced blade-receiving slots for separately receiving thin blades having a cutting edge at at least one end thereof, each slot having an open front end to enable a blade therein to be removed from the magazine by forward movement through the front end of the slot.

The housing also carries a slidable transport mechanism having a manually engageable actuator projecting from the housing and slidable in a longitudinal direction between front and rear positions. The transport mechanism also has a blade-engaging arm within the housing, whereby positioning of the actuator at the forward position causes a blade carried by the arm to project from the front end of the housing in an operative position, and movement of the actuator from the forward position to the rear position causes the blade to be retracted from the operative position into the housing and into an empty slot in the magazine. The magazine is rotatable to move the retracted blade from the arm of the transport mechanism and position a new blade from another slot onto the arm for subsequent movement by the actuator to an operative position.

SUMMARY OF THE INVENTION

The present invention provides various improvements in the knife, including the magazine and blades, described in parent application Ser. No. 08/548,941.

As described but not claimed in parent application Ser. No. 08/548,941 and described and claimed in the present application, a blade suitable for use with the knife has a thin trapezoidal body with a lower cutting edge, inclined end edges, the lower cutting edge meeting the inclined end edges to form sharp cutting points at each end, and an upper blade edge parallel to the lower cutting edge. The blade body has a recess extending inwardly into the body from the upper edge, the recess having an initial portion with a relatively narrow width and a subsequently wider portion below the initial narrower portion. The blade can be moved laterally to position the blade-engaging arm in the wider recess portion, the blade-engaging arm being wider than the narrower initial recess portion to enable the blade-engaging arm to move the blade forwardly and rearwardly with the blade suspended therefrom.

As described and claimed in the present application, the wider recess portion may extend both forwardly and rearwardly beyond the initial narrower recess portion, the wider recess portion having upper and lower edges parallel to the upper and lower edges of the blade body.

The recess may also have a narrower width portion below the wider recess portion.

The first and second finger members of the blade magazine may form a groove therein extending in a circumferential direction, the magazine also having a blade retaining ring with a circumferential gap surrounding the magazine except for the gap and seated in the groove formed by the first and second fingers, the blade retaining ring being held in a non-rotatable manner in the housing with the circumferential gap aligned with the path travel of the transport mechanism, whereby the arm of the transport mechanism can enter the circumferential gap for unloading of a used blade from the arm and the loading of a new blade onto the arm.

The housing may carry a resilient stop which, when the transport mechanism is in the forward position, prevents rotation of the magazine and blades, the resilient stop being moved by the transport mechanism to an inoperative position to permit rotation of the magazine and blades when the transport mechanism is in the rear position.

The end portions of the blade magazine may be tubular, and the knife may have an end cap removably and rotatably secured to the knife housing, the end cap having a shaft extending through the tubular end portions of the magazine parts and into a recess in the housing. The end cap may also have drive pins operable to rotate the magazine when the end cap is rotated.

The end cap may have ratchet-like teeth extending circumferentially therearound, with the housing carrying a spring-loaded detent engaging the teeth in a ratchet-like manner to enable the end cap to be rotated in increments to enable a new blade to be moved to the operative position.

DESCRIPTION OF THE DRAWINGS

One embodiment of the present invention will now be described, by way of example, with reference to the accompanying drawings, of which.

DESCRIPTION OF PREFERRED EMBODIMENT

Figure 1:
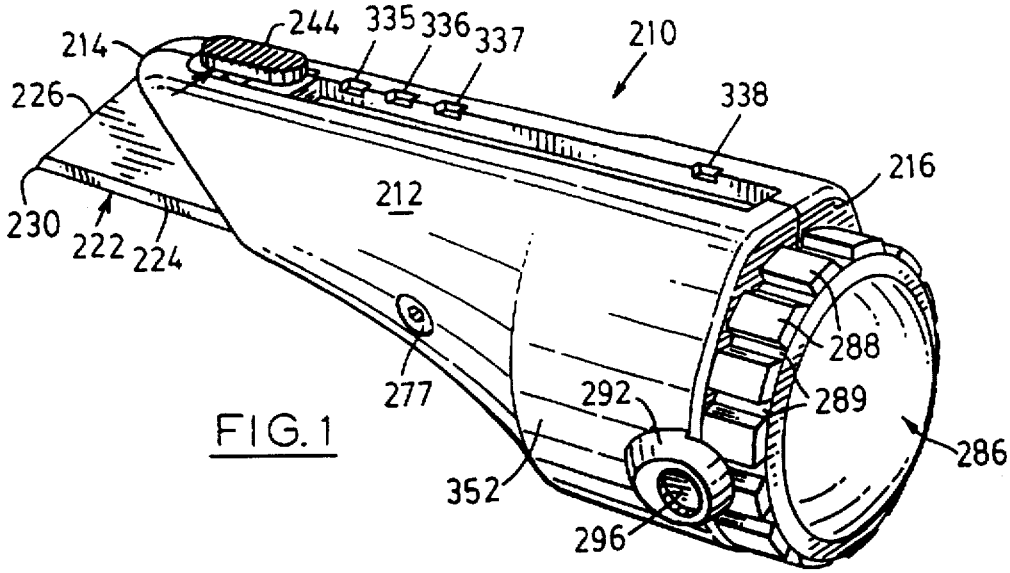
FIG. 1 is a perspective view of a utility knife in accordance with one embodiment of the invention.
Figure 3:
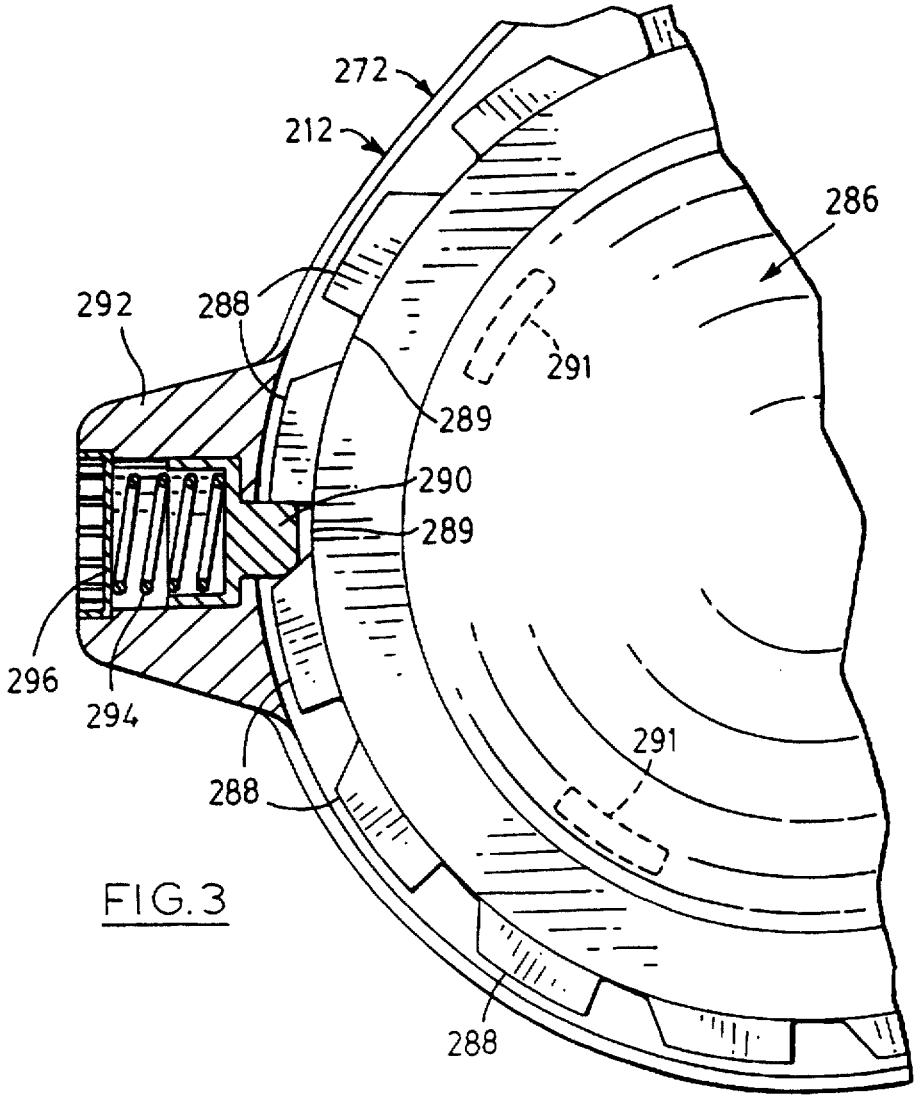
FIG. 3 is a sectional view taken along the line 3—3 of FIG. 2 and showing the ratchet mechanism associated with the magazine.

Referring to the drawings, a utility knife 210 has a manually holdable housing 212 with a front end 214 and a rear end 216. A blade magazine 218 is removably mounted in the housing 212 and is rotatable (in a manner which will be described later) about an axis parallel to the longitudinal axis of the housing 212 extending from the front end 214 to the rear end 216. The blade magazine 218 has a series of radially and longitudinally extending circumferentially spaced slots 220 for separately receiving thin blades 222, the slots 220 being open at both ends.

The blades 222 have a trapezoidal body with (see especially FIGS. 6 and 8) a lower cutting edge 224 which meets the inclined end edges 226, 228 to form sharp cutting points 230, 232 at each end. The upper blade edge 234 is parallel to the lower cutting edge 224. The upper edge 234 has a recess 236 midway along its length which extends into the body of the blade. The recess 236 has a short initial straight portion of relatively narrow width 238 with parallel sides and a subsequent wider portion 240 at the inner end of the narrower portion 238. The wider recess portion 240 extends both forwardly and rearwardly beyond the narrower recess portion 238, and has upper and lower edges parallel to the upper and lower edges 234, 224 of the blade body. The recess 236 also has a further narrow portion 239 below the wider recess portion 240.

Figure 6:
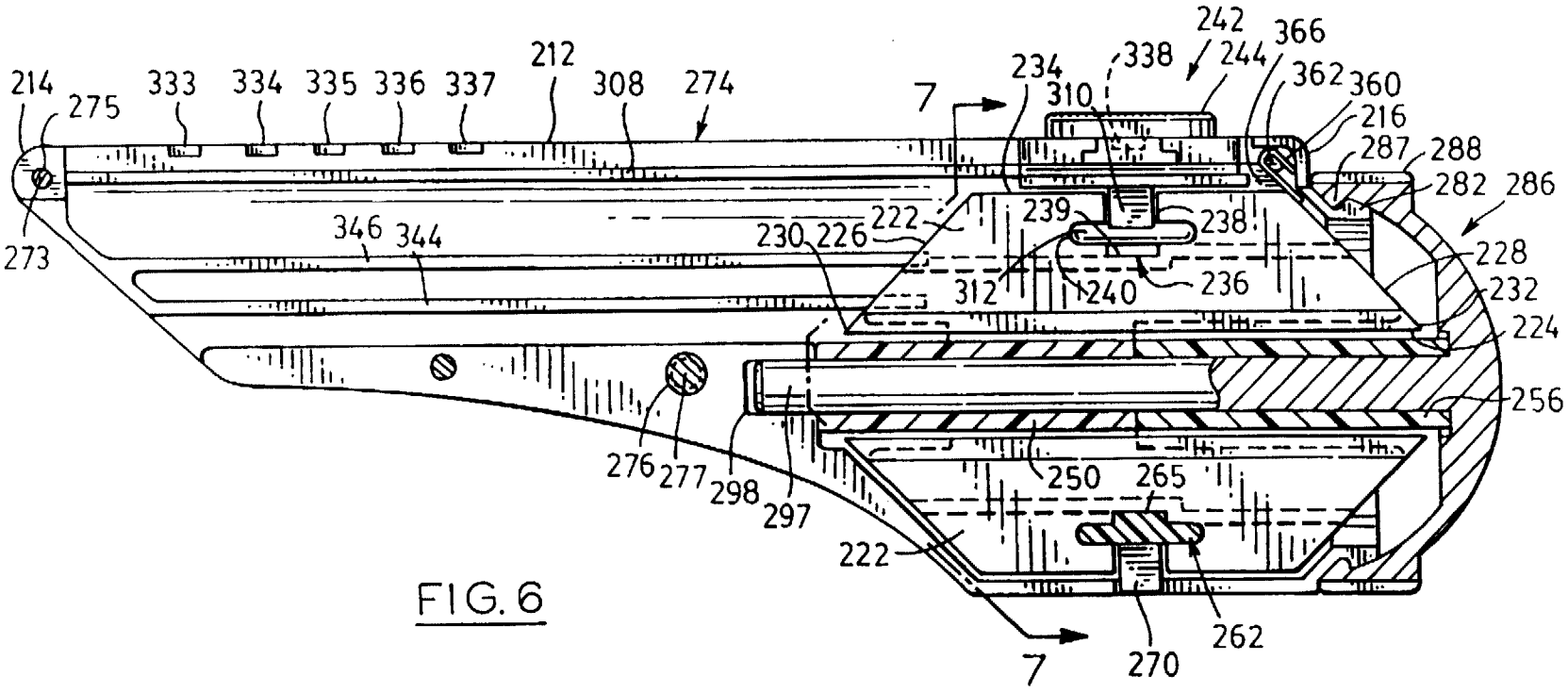
FIG. 6 is a longitudinal sectional view of the knife showing a blade in the magazine engaged by the transport mechanism.
Figure 8:
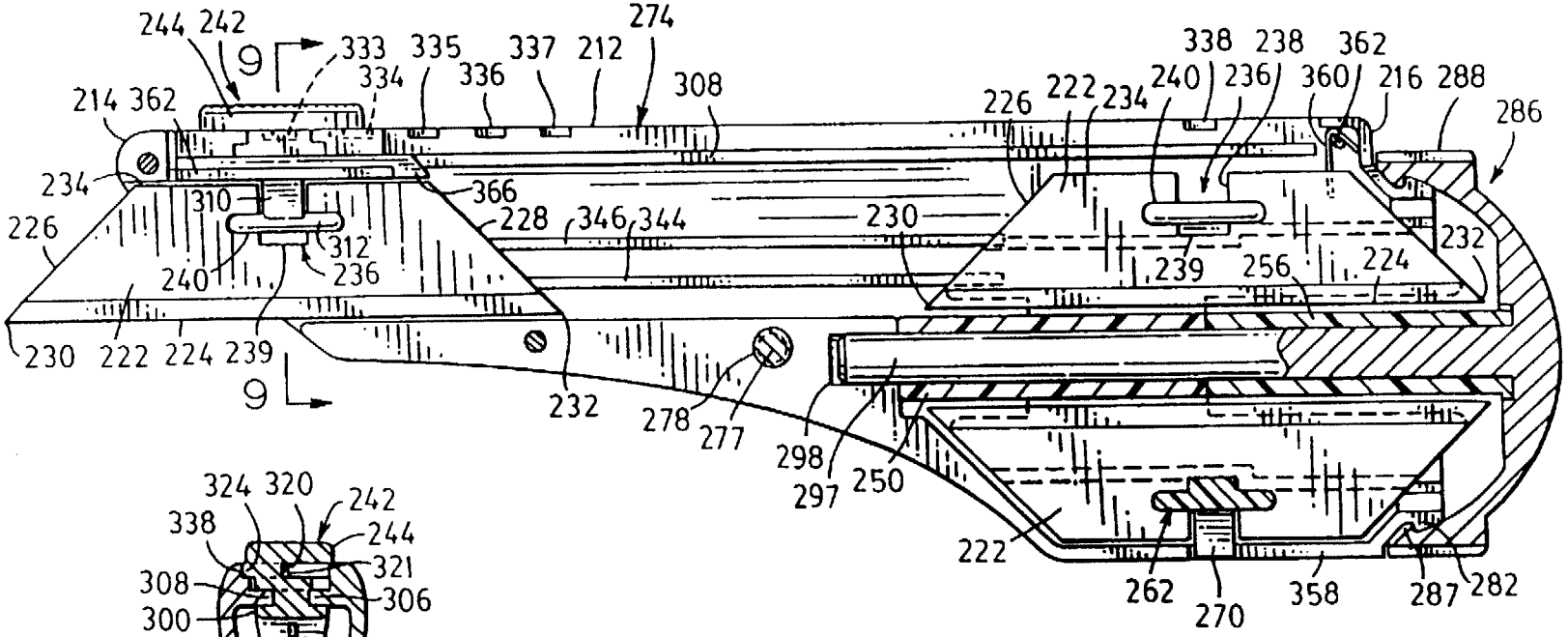
FIG. 8 is a sectional view similar to FIG. 6 but showing a blade in the operative position.

The housing 12 also carries a slidable transport mechanism 242 which, as will also be described in more detail later, has a manually engageable actuator 244 projecting from the housing and slidable in a longitudinal direction between rear and front positions shown in FIG. 6 and 8 respectively.

The blade magazine 218 has a rotatable body with two main parts 246, 248. The first part 246 has a hub-like tubular end portion 250 with a series of radially and longitudinal extending circumferentially spaced slot-forming finger T-shaped members 252. The finger members 252 extend in a longitudinal direction from the end portion 250 to the opposite end 254 of the first part 246. The finger members 252 extend longitudinally beyond the hub-like end portion 250 and their free ends form the opposite end 254 of the first magazine part 246. The second part 248 has a hub-like tubular end portion 256 with a series of radially and longitudinal extending circumferentially spaced second slot-forming T-shaped finger members 258 which extend in a longitudinal direction from the end portion 256 to the opposite end 260 of the second part 248. The finger members 258 extend longitudinally beyond the hub-like end portion 256 and their free ends form the opposite end 260 of the second magazine part 248. The fingers 252 of the first magazine part 246 have radially raised forward portions 253 and the fingers 258 of the second magazine part 248 have radially raised forward portions 259 for a purpose which will be described later.

The first magazine part 246 is assembled with the second part 248 by longitudinal movement of the first finger members 252 between the second finger members 258 to produce the blade receiving slot 220 between each adjacent pair of first and second finger members 252, 258. During assembly, the end portions of the finger members 252 of the first magazine part 246 slide over and are supported by the hub-like end portion 256 of the second magazine part 248. Similarly, the end portions of the second finger member 258 of the second magazine part 248 slide over and are supported by the hub-like end portion 250 of the first magazine part 246. When the magazine 218 is fully assembled in this manner, the hub-like end portion 250 of the first magazine part 246 abuts the hub-like end portion 256 of the second magazine part 248, as shown in FIGS. 6 and 8. Also, the radially raised portions 253 of the fingers 252 of the first magazine part 246 extend beyond the radially raised portions 259 of the fingers 258 of the second magazine part 248 to form a circumferential groove 261 therebetween which extends substantially continuously around the magazine 218, i.e. interrupted by the slots 220, see FIG. 5.

The assembly of the magazine is completed by a blade-retaining ring 262, the ring 262 having a circumferential gap 264. The ring 262 is slid along the two assembled magazine parts 246, 248 from one end thereof until the internal wall 265 of the ring 262 snaps into the circumferentially extending groove 261. The blades 222 are then loaded one at a time into the respective slots 220, with the blade-retaining ring 262 being moved around to position the gap 264 in alignment with the slot 220 into which a blade 222 is to be loaded.

The circumferential width of the gap 264 in the blade-retaining ring 262 is equal to the spacing between the blade-receiving slots 220. A blade 222 is located in each slot 220 except one namely the upper slot 220 in FIG. 5. The upper end of each blade 222 projects slightly above the circumferential periphery of the magazine 218 and the retaining ring 262 passes through the recesses 236 in each blade 221, thereby holding the blades 222 in the slots 220 with their lower cutting edges 224 slightly spaced from the hub-like end portions 250, 256 of the first and second magazine parts 246, 248. It will be noted that the internal wall 265 of the blade-retaining ring 262 is located in the lower narrower portion 239 of each blade recess 236, and that the main portion of the blade-retaining ring 262 is located in the wider recess portion 240 of each blade recess 236, see especially FIG. 5.

The blade-retaining ring 262 has a radially outwardly projecting retainer 270 a position diametrically opposite the circumferential gap 264. The purpose of the retainer 270 will be described later.

Figure 2:
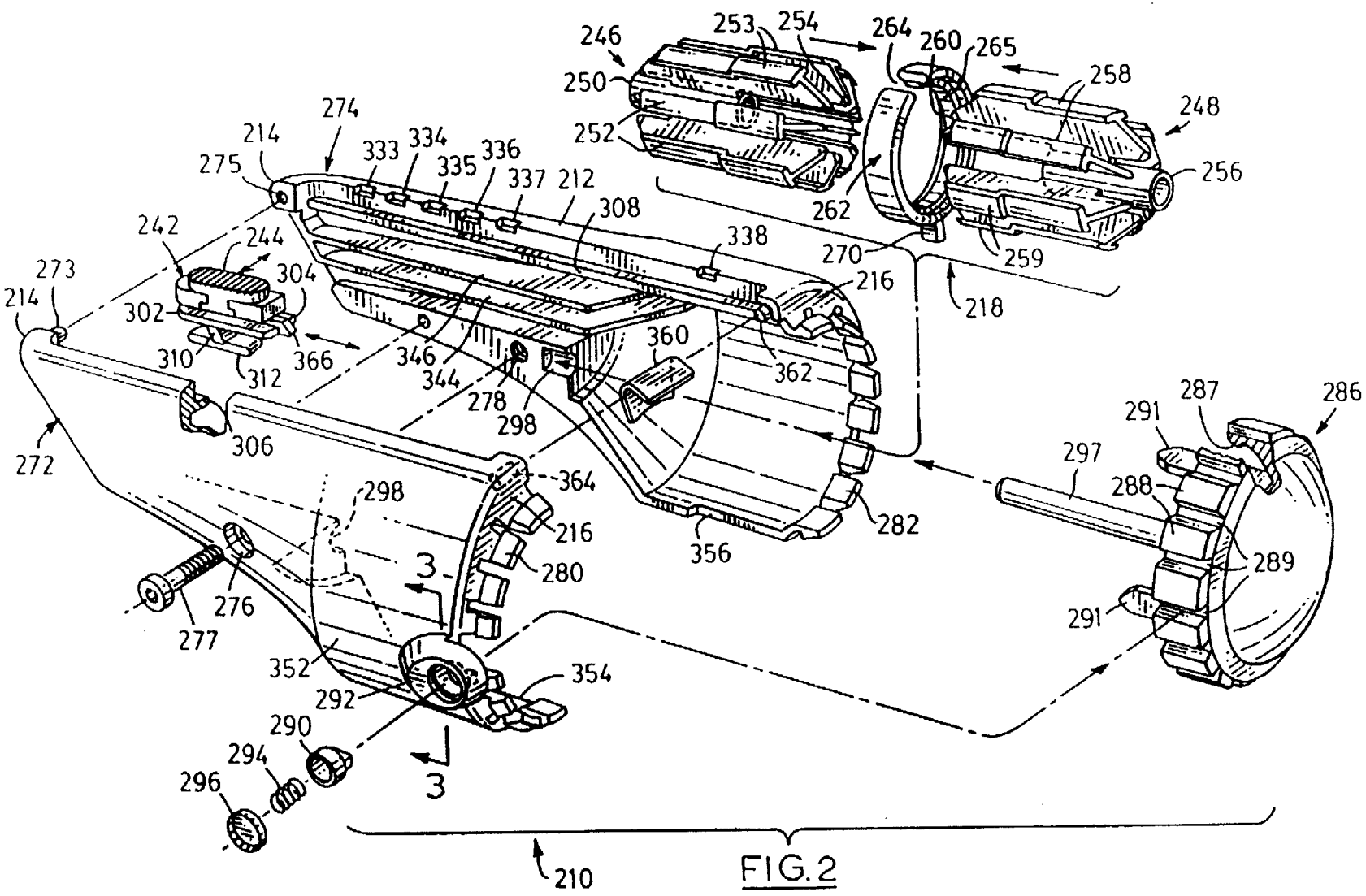
FIG. 2 is an exploded view of the knife of FIG. 1.
Figure 4:
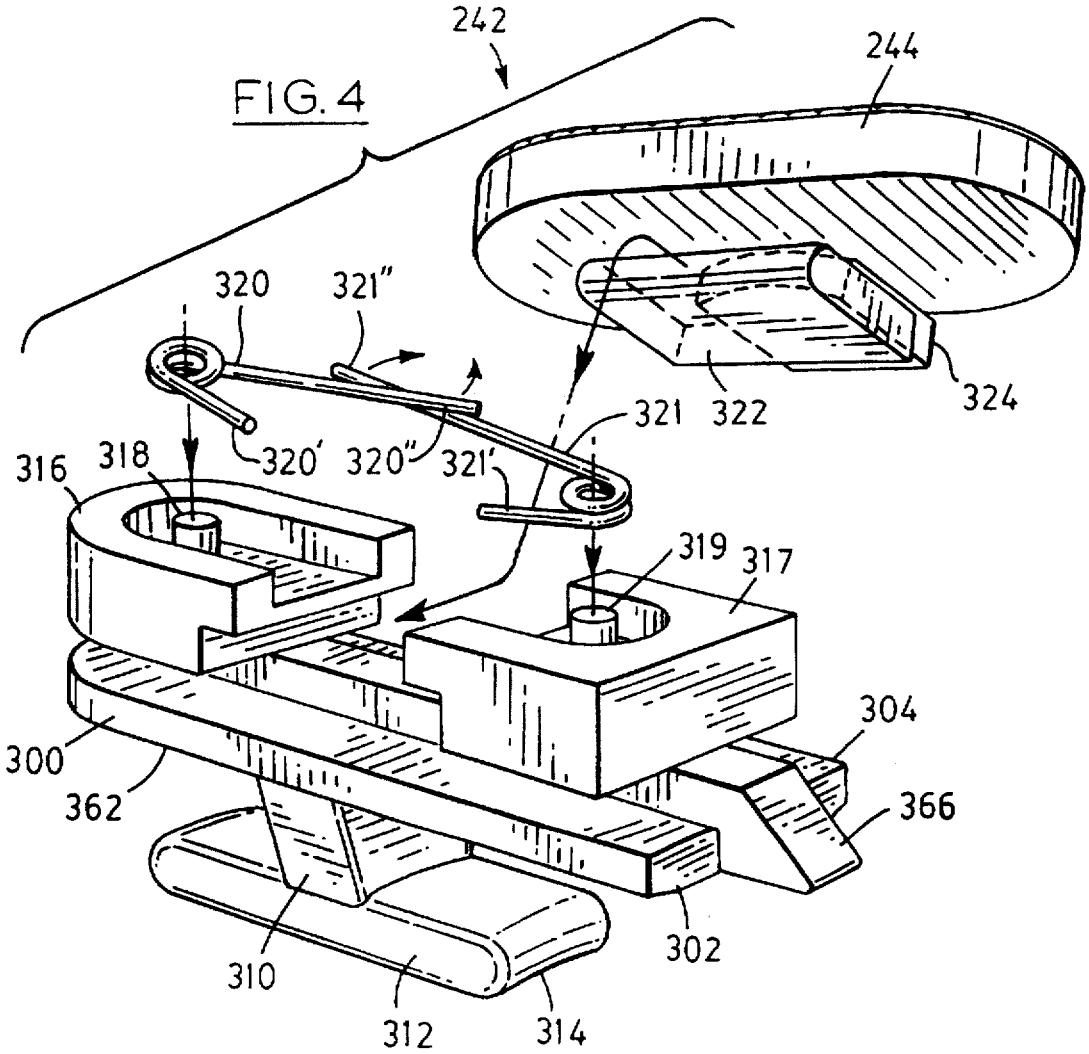
FIG. 4 is an exploded view of the actuator.

The housing 212 is formed in two longitudinally separable portions 272, 274, as most clearly shown in FIG. 2. The housing portion 272 has a laterally projecting pin 273 adjacent its front end 14 which engages in a recess 275 in the housing portion 274. Also, the housing portion 272 has an aperture 276 through which a retaining screw 277 passes to engage in a threaded recess 278 in housing portion 274 to hold the housing portions 272, 274 together. The two housing portions 272, 274 are otherwise substantially mirror images of each other.

The rear ends of the housing portions 272, 274 have circumferentially spaced resilient end cap retaining projections 280, 282 respectively which combine to receive an end cap 286 having an internal annular shoulder 287 at its front end which snaps onto the cap retaining projections 280, 282 to secure the end cap 286 to the rear ends of the housing portions 272, 274, while at the same time enabling the end cap 286 to be rotated relative thereto.

Figure 5:
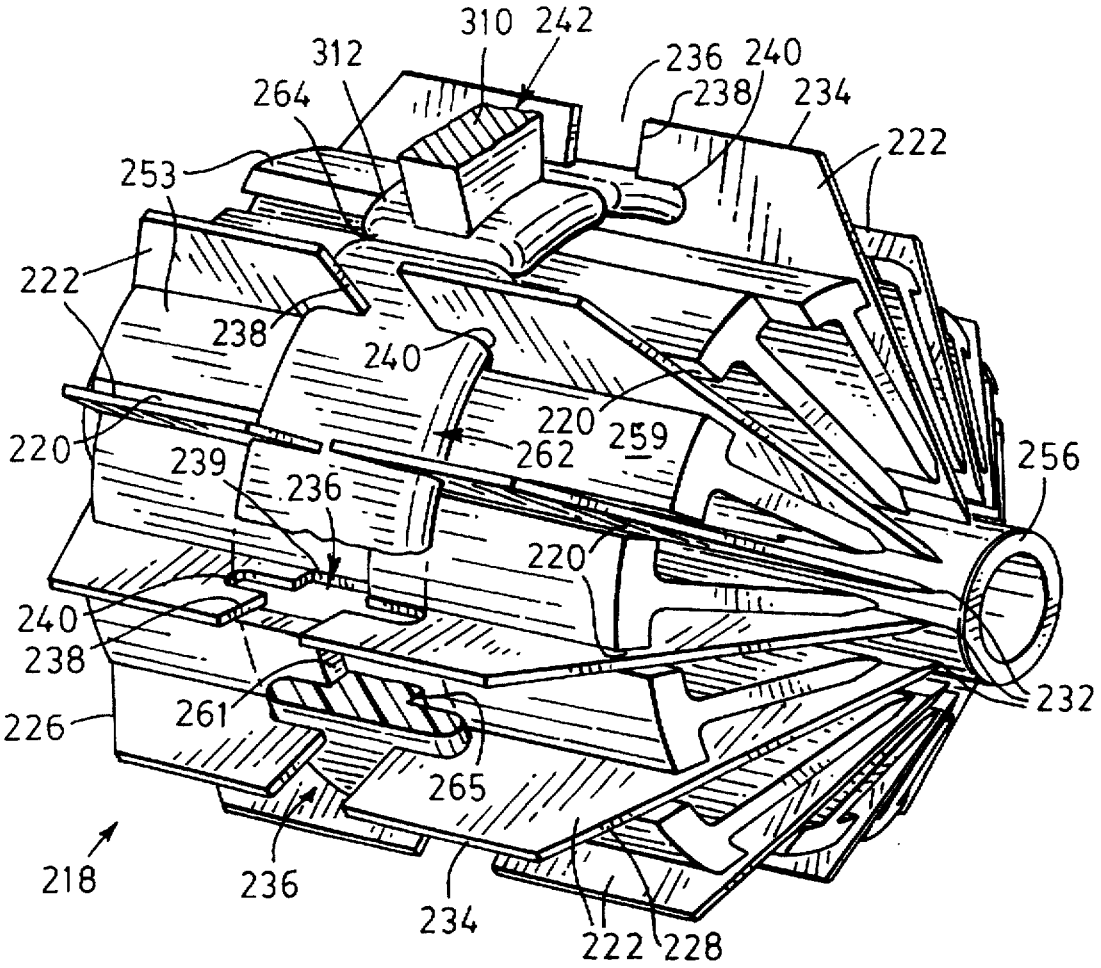
FIG. 5 is an enlarged perspective view of the blade magazine also showing the blades and part of the transfer member.

The end cap 286 has external ratchet-like teeth 288 circumferentially spaced around its circumference which co-operate with a spring-loaded detent 290, see especially FIG. 5. The detent 290 is slidably mounted in a detent housing 292 secured to the housing portion 272, and is resiliently urged by a spring 294 into engagement with the end cap teeth 288. The spring 294 is secured in place by a retainer cap 296 which is a force fit in an aperture in the detent housing 292. The teeth 288 also serve as manually-engageable means to enable the end cap 286 to be rotated in a clockwise direction looking from the rear. The number of teeth 288 equals the number of blades 222 in the magazine 218, and rotation of the end cap 286 to cause one tooth 288 to pass the detent 290 brings the next blade 222 into position for use, as will be described in more detail later. The gaps 289 between the teeth 288 are each aligned with a respective blade 222. The end cap 286 also has a central forwardly projecting shaft 297 which passes through the tubular hub portions 256, 250 of a magazine part 248, 246 respectively and also extends into a recess 298 formed by the housing portions 272, 274 to provide a shaft around which the magazine 218 can rotate. The end cap 286 also has angularly spaced forwardly projecting drive pins 291 which extend between respective pairs of blades 220 to engage the blades 220 when the end cap 286 is rotated to cause the magazine 218 to correspondingly rotate.

The transport mechanism 242 has a main body member 300 with laterally extending wing portions 302, 304 which slide along longitudinally extending ledges 306, 308 on the housing portion 272, 274 respectively. A leg 310 extends downwardly from main body member 300 and has a transversely arcuate blade carrier arm 312 at its lower end. The blade carrier arm 312 can move in to the gap 264 in the blade retaining ring 262, and has a similar cross-section to the ring 262 except that the lower surface 314 of the blade carrier arm 312 is flat and located at a level which positions the surface 314 above the grooves 261 formed by the finger members 252, 258 of the first and second magazine parts 246, 248.

Figure 9:
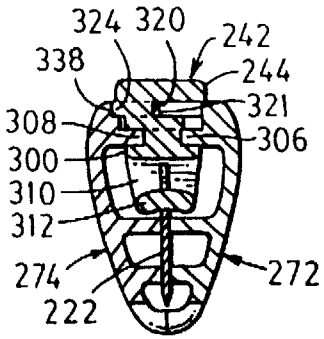
FIG. 9 is a sectional view along the line 9—9 of FIG. 8.

The main body member 300 also has forward and rear upper portions 316, 317 each carrying a post 318, 319 respectively. Springs 320, 321 are mounted on the post 318, 319 respectively. One end 320', 321' of each spring 320, 321 bears on the respective upper body portion 316, 317, and the other ends 320", 321" bear on a lower part 322 of actuator 244 which is located between the upper body portions 316, 317 to resiliently urge the actuator 244 laterally, see FIG. 9. The actuator 244 has a lateral projection 324 for a purpose which will be described later.

The housing portion 274 has six longitudinally spaced recessors 333, 334, 335, 336, 337, 338 above the ledge 308 and into each of which the projection 324 of actuator 344 can be pushed by the springs 320, 321 to lock the transport mechanism 242 into any one of six predetermined positions as will be described in more detail later.

The housing portion 274 has a vertically spaced pair of guide members 344, 346 which guide the blade 222 during travel to the operative position as will also be described in more detail later. The housing portion 274 has similar guide members (not shown).

The housing portions 272, 274 have recesses 354, 356 at the rear end of their lower edges which form a slot 358 extending forwardly from the rear end 216 of housing 312 to receive the projection 270 on blade retaining ring 262, as will be described in more detail later.

To prevent the end cap 286 in magazine 218 from being rotated when the transport mechanism 244 is in the forward position (shown in FIG. 8), a magazine locking spring 360 is mounted at the rear end of housing 212. The locking spring 360 is carried by a pin 362 extending from housing portion 274 into a recess 364 in housing portion 272. Also, for this purpose, the actuator body member 300 has a rearwardly extending projection 366. When the transport mechanism 242 is in the forward position shown in FIG. 8, spring 360 extends downwardly between two blades 222 in the magazine 218 to prevent rotation thereof. When the transport mechanism 242 is in the rear position shown in FIG. 6, the actuator projection 366 engages spring 360 and moves it rearwardly to a position clear of the blades 222 so that the blades 222 and magazine 218 can rotate.

Before describing the operation of the utility knife, it should be noted that the two housing portions 272, 274 co-operate to provide a housing 212 with a rear portion 352 of circular shape in which the magazine 218 is located, the circular shape 352 having a size and shape for ergonomically comfortable holding in the hand.

To load the knife, the end cap 286 is removed from the housing 12 by a rearward pull to disengage the annular shoulder 287 of the end cap 286 from the respective projections 280, 282 at the rear end of the housing 212, and a loaded magazine 218 is inserted into the rear end of housing 212, and projection 270 on blade retaining ring 262 enters slot 358 at the bottom of the housing 212, so that magazine 218 is thereby prevented from rotation. End cap 86 is then snapped back into place, with the shaft 297 passing through the magazine hub portions 256, 250 and extending into the recess 298 in the housing 212. Also, the end cap drive pins 291 extend between respective pairs of blades 220.

The actuator 244 is then moved laterally against springs 320, 321 to release the detent 324 from the foremost recess 333 in the housing portion 274 and is slid back to its rearmost position, i.e. adjacent the rear end of the housing 212, so that the blade carrier arm 312 on the transport member 300 moves in to the gap 264 in the blade retaining ring member 362, see FIG. 5, there being no blade 222 in the slot 220 at the top of the magazine 218. In this position, the detent 324 is engaged in the rearmost recess 338 in the housing portion 274 to lock the transport mechanism 242 in the rearmost or "docking" position. The end cap 286 is then rotated through one "click" i.e. so that one tooth 288 on the end cap passes the detent 290 to rotate the magazine 218 through one increment, i.e. to slide a blade 222 off the retaining ring 262 and onto the blade carrying arm 312, as shown in FIG. 6.

Figure 7:
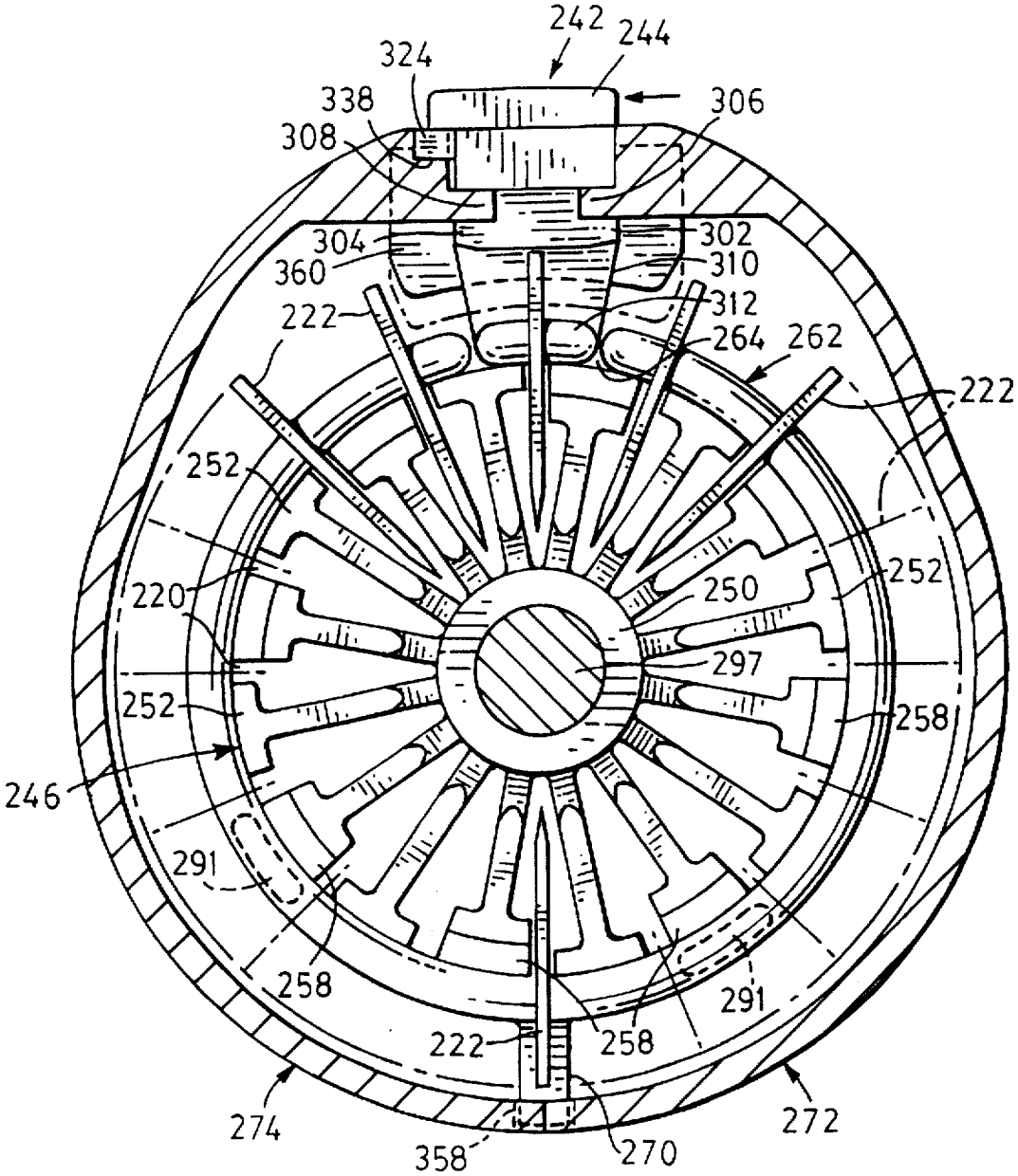
FIG. 7 is a sectional view taken along the line 7—7 of FIG. 6.

The actuator 244 is then slid forwardly, while being held in the detent releasing position, to the foremost position until the detent 324, reach recess 333 in housing portion 274. During this movement, the transport member 300 carries the blade 222 forwardly out of its slot 220 and to the operative position shown in FIG. 7, where the front part of the blade 222 projects from the front end of the housing 212. During the forward travel, the blade 222 is guided by the members 344, 346 on housing portion 272 and the corresponding guide members on housing portion 274. As will be readily apparent from FIGS. 6 and 8, the configuration of the recess 236 in the blade 222 and of the blade carrier arm 312 prevent the blade 222 from pitching movement during forward travel, i.e. from moving angularly about a transverse axis.

If less projection of the blade 222 is desired, the actuator 244 may be engaged in one of three more rearwardly positions defined by recesses 334, 335, 336 in housing portions 274. If it is wished to temporarily retract the blade 222, the actuator 244 is moved back to recess 337 in housing portion 274. It will be noted that the blade 222 is also prevented from pitching movement by engagement of its upper edge 234 with the lower surface 362 of a transport member 300, see FIGS. 6 and 8.

To change the blade 222, for example when its forward end 230 is blunt, the actuator 244 is slid back to the rearmost position so that the blunt blade 222 is returned to its original slot 220. The magazine 218 is then rotated through a further increment rotation of the end cap 86 thereby causing the blunt blade 222 to be moved off blade carrier arm 312 and onto blade retaining member 262. At the same time, a new blade 222 is moved on to the blade carrier arm 312 and can be moved to the operative position by depression and forward movement of the actuator 244.

When all the blades 222 in the magazine 218 have been used, i.e. the magazine 218 has been rotated through 360°, the magazine 218 can be taken out of the housing 212 and reversed so that the other ends 234 of the blades 222 can then be used. It is of course for this reason that slots 220 are open at both ends. After that, a new magazine 218 is used.

The advantages of the invention will be readily apparent from the foregoing description of a preferred embodiment. Other embodiments of the invention will also be readily apparent to a person skilled in the art, the scope of the invention being defined in the appended claims.

I claim:

1. A knife comprising:

a manually holdable housing having a front end and a rear end, a blade magazine removably mounted in the housing and rotatable about an axis parallel to a longitudinal axis of the housing extending from the front end to the rear end, said blade magazine having a series of radially and longitudinally extending circumferentially spaced blade-receiving slots for separately receiving thin blades having a cutting edge at at least one end thereof, each slot having an open front end to enable a blade therein to be removed from the magazine by forward movement through the front end of the slot, said housing also carrying a slidable transport mechanism having a manually engageable actuator projecting from the housing and slidable in a longitudinal direction between front and rear positions, said transport mechanism also having a blade-engaging arm within the housing, whereby positioning of the actuator at the forward position causes a blade carried by the arm to project from the front end of the housing in an operative position, and movement of the actuator from the forward position to the rear position causes the blade to be retracted from the operative position into the housing and into an empty slot in the magazine.

said magazine being rotatable to move said retracted blade from the arm of the transport mechanism and to position a new blade from another slot onto the arm for subsequent movement by the actuator to an operative position, the blade magazine comprising a first part having a first tubular end portion with a series of radially and longitudinally extending circumferentially spaced first slot-forming finger members, said first finger members extending in a longitudinal direction from said first end portion to an opposite end of said first part, and a second part having a second tubular end portion with a series of radially and longitudinally extending circumferentially spaced second slot-forming finger members, said second finger members extending in a longitudinal direction from said second end portion to an opposite end of said second part, said first part having been assembled with said second part by longitudinal movement of the first finger members between the second finger members to provide a blade receiving slot between each adjacent pair of first and second finger members, each slot being open at at least a front end thereof to enable blade in the slot to be removed therefrom by the transport mechanism by longitudinal sliding movement through said front end of the slot, the first and second finger members of the blade magazine forming a groove therein extending in a circumferential direction, said magazine also having a blade retaining ring with a circumferential gap surrounding the magazine except for the gap and seated in the groove formed by the first and second fingers, said blade retaining ring being held in a non-rotatable manner in the housing with the circumferential gap aligned with the path of travel of the transport mechanism, whereby the arm of the transport mechanism can enter the circumferential gap for unloading of a used blade from the arm and the loading of a new blade on to the arm.

2. A knife according to claim 1 wherein the first finger members of the blade magazine have front end portions slidably engaged over and supported by the tubular end portion of the second part, and the second finger members have front end portions slidably engaged over and supported by the tubular end portion of the first part.

3. A knife according to claim 1 wherein each slot of the blade magazine contains a blade having a thin trapezoidal body with a lower cutting edge, inclined end edges, said lower cutting edge meeting the inclined end edges to form sharp cutting points at each end, and an upper blade edge parallel to the lower cutting edge, the blade body having a recess extending inwardly into the body from said upper edge, the recess having an initial portion with a relatively narrow width and a subsequent wider portion below said initial narrower portion.

4. A knife according to claim 3 wherein the wider recess portion of the blade recess extends both forwardly and rearwardly beyond the initial narrower recess portion.

5. A knife according to claim 4 wherein the wider recess portion of the blade recess has upper and lower edges parallel to the upper and lower edges of the blade body.

6. A knife according to claim 5 wherein the blade recess also has a narrower width portion below the wider width portion.

7. A knife according to claim 1 wherein the housing has an end cap removably and rotatably secured thereto, the end cap having a shaft extending through the tubular end portions of the magazine parts and into a recess in the housing, said end cap also having drive pins operable to rotate the magazine when the end cap is rotated.

8. A knife according to claim 7 wherein the end cap has ratchet-like teeth extending circumferentially around, and the housing carries a spring-loaded detent engaging the teeth in a ratchet-like manner to enable the end cap to be rotated in increments to enable a new blade to be moved to the operative position.

9. A knife according to claim 1 wherein the housing carries a resilient stop wherein, when the transport mechanism is in the forward position, prevents rotation of the magazine and blades, said resilient stop being moved by the transport mechanism to an inoperative position to permit rotation of the magazine and blades when the transport mechanism is in the rear position.

10. A blade magazine comprising:

a body rotatable about a longitudinal axis and having a front end and a rear end, the body having a series of radially and longitudinally extending circumferentially spaced blade-receiving slots for respectively receiving thin blades having a cutting edge at at least one end thereof, each slot having an open front end to enable a blade therein to be removed from the slot by forward movement through the front end of the slot, the rotatable body comprising first and second parts, the first part having a first tubular end portion with a series of radially and longitudinally extending circumferentially spaced first slot-forming finger members, said first finger members extending in a longitudinal direction from said first end portion to an opposite end of said first part, and the second part having a second tubular end portion with a series of radially and longitudinally extending circumferentially spaced second slot-forming finger members, said finger members extending in a longitudinal direction from said second end portion to an opposite end of said second part, said first part having been assembled with said second part by longitudinal movement of the first finger members between the second finger members to provide a blade receiving slot between each adjacent pair of first and second finger members, said slot being open at at least one end to enable a blade in the slot to be removed therefrom through the open end thereof, the first and second finger members forming a groove extending in a circumferential direction, said magazine also having a blade retaining ring with a circumferential gap surrounding the magazine except for the gap and seated in the groove formed by the first and second finger members.

11. A blade magazine according to claim 10 wherein the first finger members have first end portions slidably engaged over and supported by the end portion of the second part, and the second finger members have first end portions slidably engaged over and supported by the end portion of the first part.

12. A blade magazine according to claim 10 wherein each slot contains a blade having a thin trapezoidal body with a lower cutting edge, inclined end edges, said lower cutting edge meeting the inclined end edges to form sharp cutting points at each end, and an upper blade edge parallel to the lower cutting edge, the blade body having a recess extending inwardly into the body from said upper edge, said blade retaining ring passing through the recess of each blade.

13. A blade magazine according to claim 12 wherein the blade recess has an initial portion with a relatively narrow width and a subsequent wider portion below said initial narrower portion.

14. A blade magazine according to claim 13 wherein the wider recess portion of the blade recess extends both forwardly and rearwardly beyond the initial narrower recess portion.

15. A blade magazine according to claim 14 wherein the wider recess portion of the blade recess has upper and lower edges parallel to the upper and lower edges of the blade body.

16. A blade magazine according to claim 15 wherein the blade recess also has a narrower width portion below the wider recess portion.

17. A blade for a knife having:

a thin trapezoidal body with a lower cutting edge, inclined end edges, said lower cutting edge meeting the inclined end edges to form sharp cutting points at each end, and an upper blade edge parallel to the lower cutting edge, the blade body having a recess extending inwardly into the body from said upper edge, the recess having an initial portion with a relatively narrow width and a subsequent wider portion below said initial narrower portion, whereby the blade can be moved laterally to position a blade carrier arm in the wider recess portion, the blade carrier arm being wider than the narrower initial recess portion to enable the blade carrier arm to move the blade forwardly and rearwardly with the blade suspended therefrom, the wider recess portion extending both forwardly and rearwardly beyond the initial narrower recess portion and having upper and lower edges parallel to the upper and lower edges of the blade body, the recess also having a narrower width portion below the wider recess portion.

* * * * *